United States Patent [19]

Pate et al.

[11] 4,309,855

[45] Jan. 12, 1982

[54] WALL DRAINAGE SYSTEM

[75] Inventors: Harold T. Pate, Solon; Helmut P. Fochler, Chagrin Falls, both of Ohio

[73] Assignee: Indian Head Inc., New York, N.Y.

[21] Appl. No.: 146,131

[22] Filed: May 2, 1980

[51] Int. Cl.[3] ..... E02B 11/00; E02D 31/02

[52] U.S. Cl. ..... 52/169.5; 405/45; 405/48

[58] Field of Search ..... 52/169.4, 309.4, 169.11, 52/302, 303; 405/43, 45, 46, 48; 210/170

[56] References Cited

U.S. PATENT DOCUMENTS

| | | | |
|---|---|---|---|
| 1,734,777 | 11/1929 | Pike | 52/169.5 |
| 2,602,764 | 7/1952 | Billingham | 405/36 |
| 3,936,380 | 2/1976 | Boske | 405/45 |
| 4,182,581 | 1/1980 | Uehara | 405/43 |

FOREIGN PATENT DOCUMENTS

| | | | |
|---|---|---|---|
| 2555036 | 6/1976 | Fed. Rep. of Germany | 405/43 |

*Primary Examiner*—John E. Murtagh
*Attorney, Agent, or Firm*—William R. Laney

[57] ABSTRACT

A wall drainage system for protecting foundations and basement walls from water contact and seepage and including a water-impermeable synthetic resin backing plate adapted for securement to a surface to be protected and defining drainage channels along one side thereof facilitating drainage of water downwardly along the backing plate through the channels. A water-permeable synthetic resin strainer film is secured to the backing plate across the drainage channels. A synthetic resin water-receiving footer structure is connected to the lower end of the backing plate and includes a foraminous, synthetic resin bead pack and a perforated drainage pipe at least partially surrounded by the bead pack.

12 Claims, 4 Drawing Figures

WALL DRAINAGE SYSTEM

BACKGROUND OF THE INVENTION

1. Field of the Invention

This invention relates to protective drainage devices used for protecting masonry walls from moisture contact and infiltration, and more particularly, to drainage plate systems useful for protecting foundations and basements from ground water contacting and infiltrating such foundations and basement wall structures.

2. Brief Description of the Prior Art

In protecting the walls of basements, or other below-grade foundation walls, from deleterious contact with ground water, various proposals have been advanced for shielding these structures. In the simplest form, it has been proposed to coat them with tar or a viscous, settable or thixotropic sealant material which seals the pores of the masonry and prevents water infiltration. Some of these films or coatings have hydrophobic characteristics which tend to turn away or repel the water which comes in contact therewith, and thus effectively shield and protect the below-grade foundation or basement wall.

In other arrangements, some of which have been patented, it is proposed to place adjacent the portion of the wall which is below grade, a synthetic resin structure which blocks the water from contact with the wall, and affords vertical channels to allow the water to drain downwardly to the bottom of the wall where it is then carried away in a perforated footer pipe, or some similar water-collecting structure. In some types of construction, the perforated footer pipe placed at the bottom of the foundation or basement wall is embedded in a bed of gravel placed in a pit below the protected wall.

One arrangement which has been patented and which is of the general character described is the vertical drainage system shown in U.S. Pat. No. 3,704,362. Here a mat or body of thermoplastic filaments is placed over the coated outer side of a basement wall between the wall and the earth. Water drains downwardly through these filaments to a perforated pipe disposed at the lower end of the filament mat, and this pipe collects the percolating water and drains it away from the protected wall.

A protective membrane having corrugations formed therein for spacing the membrane from a foundation wall to be protected, and to provide air channels between a protective sheet and the foundation wall, is illustrated and described in U.S. Pat. No. 3,888,087. Small vertical ribs are provided on the membrane to provide water channels to allow the water to drain down the membrane to the bottom of the foundation wall. A drainage pipe is located adjacent the footing at the bottom of the foundation wall for picking up and disposing of water which has drained down the protective membrane. Another patent showing a structure of this general type is U.S. Pat. No. 4,142,344. A channelized protective structure advocated for attachment to basement and foundation wall structures to protect them from moisture is also shown in Agro et al. U.S. Pat. No. 3,561,177.

In U.S. Pat. No. 4,045,964, a subterranean panel drain is illustrated which includes a unitary prefabricated panel having a series of serpentine shaped, vertically extending corrugations in the panel which are open to receive water migrating toward a foundation to which the subterranean panel is attached. A conventional drain pipe is placed at the base of the foundation and is embedded in a gravel pack or body of crushed stone. The gravel pack extends over the lower portion of the panel drain member so as to receive water draining therefrom.

In U.S. Pat. No. 3,563,038, a panel is provided which includes a longitudinal water channeling core having a series of vertically extending channels formed therein. These channels are covered by a water-impervious sheet of material which prevents choking or blocking of the channels by passage of earth or particles of dirt through the sheet material. At the lower end of the channels, a perforated tubular structure is formed integrally with the channel-carrying drain unit to receive water which drains downwardly in the channels. Another patented structure quite similar to that shown in U.S. Pat. No. 3,563,038 is the subterranean wall drain illustrated and described in U.S. Pat. No. 3,654,765.

In U.S. Pat. No. 3,287,866, vertical drainage channels are formed within the foundation wall itself, and at the lower end of these channels they open out into a gravel pack in which a perforated drain pipe is located.

Another construction for protecting a subterranean basement structure at a location where the hydrostatic head of ground water is greatest is shown in U.S. Pat. No. 3,283,460. Here an L-shaped body of a synthetic resin material is constructed to fit between the lower part of the basement wall and the underlying footing. The L-shaped drainage member is provided with channels which are also L-shaped, and which receive any water which has infiltrated the basement wall to the inner side thereof, and drain this water from adjacent the floor slab to a gravel pack and drainage pipe laid under the floor slab.

In all of the cited patents, the systems in use generally require some form of securement of an external block or plate, having grooves and channels formed therein, to the surface of the basement or foundation wall, and then the establishment of communication of the lower end of this plate with a gravel pack. The bed of gravel must be specially laid and positioned for receiving a perforated drainage pipe to collect and remove the water from adjacent the lower part of the foundation wall.

BRIEF DESCRIPTION OF THE PRESENT INVENTION

The present invention provides an improved wall drainage system for protecting sub-grade foundations and basement walls from contact with water and from moisture seepage. The system includes a water-impermeable synthetic resin backing plate which is adapted for securement to the surface to be protected, and which defines drainage channels along one side of the backing plate to facilitate gravity drainage of water. A water-permeable synthetic resin strainer film is secured to the backing plate across the drainage channels to permit water to move from the earth into the drainage channels, yet prevent dirt from choking these channels. The backing plate and protective strainer film combination is secured at its lower end to a synthetic resin water-receiving footer structure adapted to receive water from the drainage channels. The footer structure includes a foraminous, synthetic resin bead pack and a perforated drainage pipe which is at least partially embedded in the bead pack, and may be completely surrounded by the bead pack. The bead pack includes a plurality of synthetic resin particles ranging in size from pea-sized to peanut-sized, and is permeable to water drainage between the beads. Water can flow through the bead pack to the perforated drainage pipe from the drainage plate structure.

A significant advantage of the present invention is the susceptibility of the system to placement so as to afford full protection to a basement or sub-grade foundation wall and removal of water from the proximity of the wall, without the necessity to haul large and heavy loads of gravel, and to provide equipment or manpower for positioning the gravel in a trench provided for its accommodation and for receipt of the perforated drainage pipe within the gravel bed.

An object of the invention is to provide a wall drainage system which can be very quickly placed in a protective position on a sub-grade masonry structure, and can be accommodated in its shape and configuration to various types of footings which support such structure.

Additional objects and advantages of the invention will become apparent as the following detailed description of the invention is read in conjunction with the accompanying drawings which illustrate a preferred embodiment of the invention.

GENERAL DESCRIPTION OF THE DRAWINGS

DETAILED DESCRIPTION OF PREFERRED EMBODIMENTS OF THE INVENTION

Figure 1:
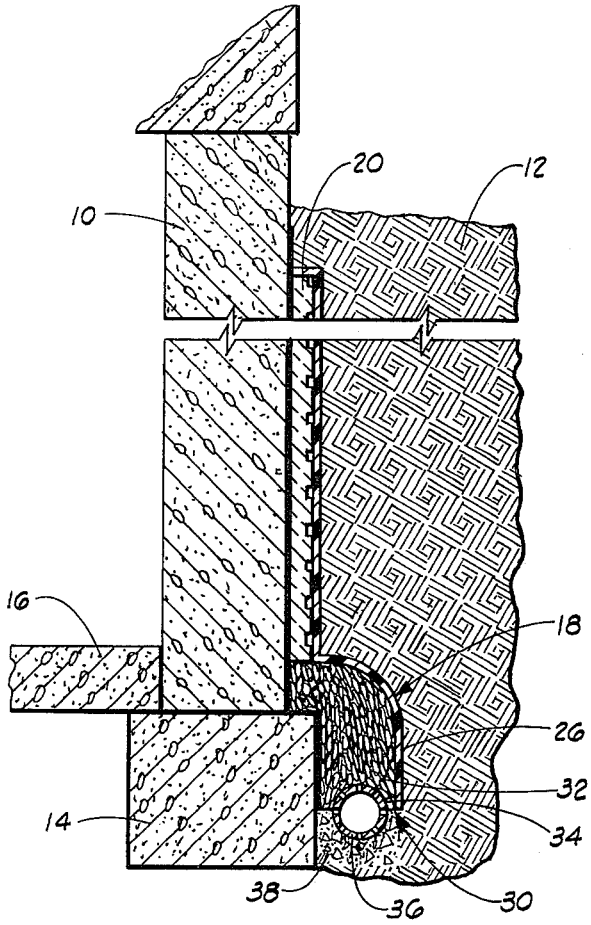
FIG. 1 illustrates a sectional view through the earth and through a foundation wall, a portion of which is broken away, and illustrating, in section, the wall drainage system of the present invention placed in an operative position adjacent the basement wall.

Referring initially to FIG. 1 of the drawings, a basement wall 10 extends vertically downwardly in the earth 12 and rests upon a footing 14 which, in addition to supporting the basement wall, partially supports a floor or slab 16. In order to protect the foundation wall 10 from deleterious contact with ground water percolating through the earth 12 into contact with the wall, the wall drainage system 18 of the present invention is provided.

The wall drainage system 18 includes a water-impermeable, synthetic resin backing plate 20 which is preferably configured as a right parallelepiped. The water-impermeable backing plate 20 can typically be between about ½ inch and 2 inches in thickness and is suitably formed from a closed-cell resin, such as closed-cell polystyrene foam. The backing plate 20 includes an inner side or surface **20*a* and an outer side or surface 20*b*. The outer side of the backing plate 20 is formed or molded to provide a plurality of vertically extending channels or indentations 22. In the illustrated embodiment of the invention, these channels 22 are formed by embossing a plurality of raised rectangular protuberances 24 on the side 20*b*** of the backing plate.

Superimposed over the outer side **20*b* of the backing plate 20 is a water-permeable synthetic resin strainer film or sheet 26. The water-permeable synthetic resin film 26 is any suitable synthetic resin or plastic which is permeable to water by means of a plurality of very small capillaries which extend through the film. This construction allows water to pass through the strainer film 26 but prevents dirt from passing through the film so as to clog or choke the channels 22**.

Adjacent the lower portion of the backing plate 20 and the strainer film 26, a synthetic resin water-receiving footer structure is attached to the plate and film and is designated generally by reference numeral 30. The footer structure 30 is comprised of a body of beads or discrete particles of synthetic resin which are bonded to each other at peripheral points of contact to form a synthetic resin bead pack 32. The bead pack 32 is porous and facilitates water drainage downwardly between the beads composing the pack. The synthetic resin beads in the bead pack 32 can range in size from that approximating a pea to a size approximating that of peanuts. Styrofoam particles are suitable for the formation of the bead pack.

In the embodiment of the invention illustrated in FIG. 1, the strainer film 26 is brought down around the outer side of the bead pack 32 and terminates adjacent the lower end of the bead pack. The lower side of the bead pack 32 is geometrically configured to define a semicylindrical groove or channel 34. The semicylindrical channel 34 is complementary in configuration to a perforated drainage pipe 36 of conventional construction. The drainage pipe 36 has a plurality of radial perforations extending through its wall from the hollow interior thereof for receiving water from the zone around the drainage pipe.

Below the drainage pipe 36, a gravel bed 38 of conventional character is provided, and supports the drainage pipe in a location at the lower side of the bead pack 32.

The nature of the bead pack 32 is such that it may be preformed to fit a particular footing and basement wall at a line of intersection, or, alternatively, it may be cut and shaped at the construction site to achieve the desired fit for a particular structural configuration. It should be noted, however, that the beads in the bead pack 32, in addition to being bonded peripherally to each other so as to provide interstitial space between the beads, are also bonded to the lower end of the backing plate 20. It should further be noted that in some forms of construction, it will be desirable to extend the backing plate 20 all the way to the upper side of the footer 14 so as to completely mask or protect the basement wall 10 down to its point of support upon the footer. This construction is illustrated in an alternate embodiment of the invention shown in FIG. 4.

Figure 2:
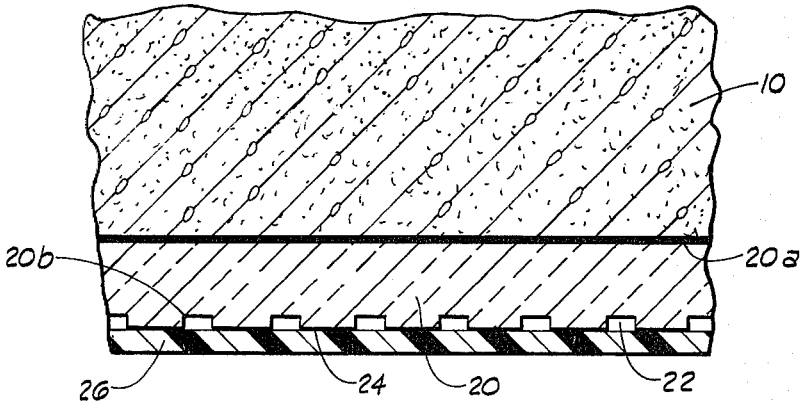
FIG. 2 is a sectional view through a portion of the basement wall and through the wall drainage system of the invention, illustrating the appearance of this assembly in cross-section.
Figure 3:
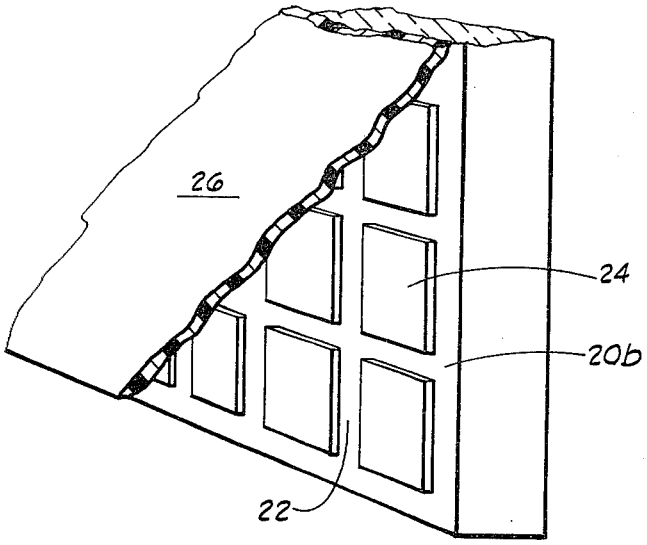
FIG. 3 is a perspective view of a portion of the wall drainage system of the invention with a part of the water-permeable synthetic resin strainer film or sheet broken away to show the manner in which the water-impermeable backing plate is constructed.
Figure 4:
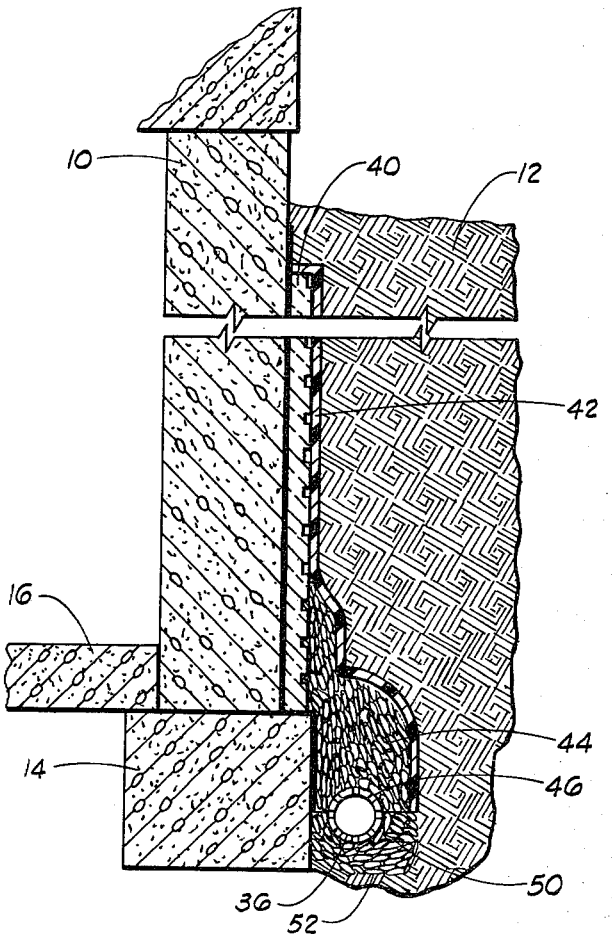
FIG. 4 is a view similar to FIG. 1 but illustrating a modified embodiment of the invention.

In illustrating an alternate embodiment of the invention in FIG. 4 of the drawings, identical reference numerals have been employed to identify identical structures and elements where such are used and correspond to structures and elements shown in FIG. 1. In the embodiment here illustrated, a backing plate 40 is configured and constructed substantially identically to the backing plate 20 shown in FIG. 1 except that the backing plate 40 extends downwardly into contact with the footing 14. A water-permeable synthetic resin strainer film 42 is secured over the outer side of the backing plate 40 to cover and protect vertical channels formed therein in a fashion similar to the manner of coverage and protection of the vertical channels illustrated in the embodiment of FIGS. 1–3. The strainer film 42 includes a lower end portion which is diverted outwardly from the backing plate 40 and joined to the upper end portion of a bead pack 44. The bead pack 44 is constructed substantially identically to that described in discussing the embodiment of FIGS. 1–3, and is thus provided at its lower end with a semicylindrical channel or groove 46 for receiving the upper portion of the cylindrical perforated drainage pipe 36.

In the embodiment of the invention shown in FIG. 4, a lower or supporting bead pack 50 is provided to support the perforated drainage pipe 36 and is emplaced in a suitable ditch or excavation 52 formed in the earth 12. The upper surface of the supporting bead pack 50 is planar and is adapted to mate with the planar lower surface of the bead pack 44. Moreover, the upper side of the supporting bead pack 50 is semicylindrically grooved so as to provide support for the drainage pipe 36 in the manner shown.

The wall drainage system illustrated in FIG. 4 is placed in position similarly to that shown in FIG. 1. Initially, however, the supporting bead pack 50 will be placed in a prepared excavation or ditch and the perforated drainage pipe 36 laid in position in the semicylindrical groove provided therefor in the supporting bead pack. The upper portion of the wall drainage system is then fitted over the supporting bead pack 50 and drainage pipe 36, and the backing plate 40 is then bonded by an adequate mastic or adhesive to the basement wall 10 in the manner hereinbefore described.

It will be perceived from the foregoing description of the invention that the wall drainage system of the invention provides effective protection to sub-grade foundations or basement walls and prevents ground water from contacting and infiltrating these structures. The system is meritorious with respect to the prior art since it can be quickly and easily installed and utilized without the necessity for special tools and without the necessity to haul large amounts of gravel or aggregate. Moreover, by the integral formation of the bead pack with the drainage plate and its overlying strainer film, the installer can quickly and easily complete the protection of the sub-grade wall in one installation operation.

Although preferred embodiments of the invention have been herein illustrated and described, it will be understood that various changes and innovations in the illustrated structure can be effected without departure from the basic principles which underlie the invention. Changes and innovations of this type are therefore deemed to be circumscribed by the spirit and scope of the invention except as the same may be necessarily limited by the appended claims or reasonable equivalents therefor.

What is claimed is:

1. A wall drainage system for protecting foundations, basement walls and the like comprising:

a water-impermeable synthetic resin backing plate having a first side adapted for securement to a surface of the structure to be protected and defining drainage channels along a second side thereof opposite said first side;

a water-permeable synthetic resin strainer film secured to the backing plate across said drainage channels to prevent dirt from clogging said channels; and a bead pack assembly connected to the lower portion of said drainage plate for receiving water from said drainage channels, said bead pack assembly including:

a plurality of discrete synthetic resin beads peripherally bonded to each other to form a porous bead pack; and a perforated drainage pipe below, and at least partially surrounded by, said porous bead pack for receiving water therefrom.

2. A wall drainage system as defined in claim 1 wherein said backing plate is closed cell polystyrene in a rectangular parallelepiped configuration.

3. A wall drainage system as defined in claim 1 wherein said bead pack includes upper and lower portions positioned above and below said drainage pipe, respectively, and together enclosing and surrounding said drainage pipe.

4. A wall drainage system as defined in claim 1 wherein said resin beads range in size between pea size and peanut size.

5. A building structure comprising:

a vertically extending sub-grade wall projecting down into the earth;

a footing supporting the wall;

a protective wall drainage system including:

a flat, rectangularly configured drainage plate extending downwardly along the wall to a location adjacent the footing and having one side surface bonded to the wall to position the drainage plate between the wall and the earth;

means defining earth-free drainage channels along a second side of said plate opposite said first side facilitating gravitational drainage of water downwardly along said second side; and a bead pack of multiple, discrete, interbonded synthetic resin beads connected to the lower end portion of the drainage plate for receiving water and having one side abutting said footing; and a perforated pipe for receiving water percolating through said bead pack to the lower side thereof.

6. A building structure as defined in claim 5 wherein said channel defining means comprises a water-permeable sheet secured to said second side to protect said second side from water contact, and projecting to, and secured to, said bead pack.

7. A bead pack assembly for providing a water drainage path adjacent a subgrade structural member comprising:

a plurality of discrete synthetic resin beads bonded to each other at peripheral contact points to form a water permeable bead pack body, said body having an upper side and a lower side, and said lower side of said bead pack defining a pipe receiving recess;

a perforated pipe in said recess with the perforations therein positioned to receive water from said bead pack body; and means attached to said bead pack body for locating said body adjacent the lower portion of a subgrade structural member.

8. A bead pack assembly as defined in claim 7 wherein said locating means comprises a water permeable strainer film having a first portion extended along one side of said bead pack body and secured thereto, and a second portion adapted for securement to a backing plate mounted on the subgrade structural member.

9. A bead pack assembly as defined in claim 7 wherein said locating means comprises a neck formed on said bead pack body and including discrete synthetic resin beads, said neck having a configuration to fit over a footing forming a part of said subgrade structural member.

10. A bead pack assembly as defined in claim 7 wherein said synthetic resin beads range in size from about pea size to about peanut size.

11. A bead pack assembly as defined in claim 10 wherein said locating means comprises a water permeable strainer film having a first portion extended along one side of said bead pack body and secured thereto, and a second portion adapted for securement to a backing plate mounting on the subgrade structural member.

12. A bead pack assembly as defined in claim 7 and further characterized as including a second and lower bead pack body positioned below said perforated pipe and including a recess in the upper side thereof for receiving and supporting a portion of said pipe.

* * * * *